United States Patent [19]

Wood

[11] Patent Number: 4,583,364

[45] Date of Patent: Apr. 22, 1986

[54] PISTON CENTERING METHOD AND APPARATUS FOR FREE-PISTON STIRLING ENGINES

[75] Inventor: James G. Wood, Albany, Ohio

[73] Assignee: Sunpower, Inc., Athens, Ohio

[21] Appl. No.: 766,793

[22] Filed: Aug. 19, 1985

[51] Int. Cl.[4] ..... F02G 1/04

[52] U.S. Cl. ..... 60/520

[58] Field of Search ..... 60/520

[56] References Cited

U.S. PATENT DOCUMENTS 4,183,214 1/1980 Beale et al. ..... 60/520

4,404,802 9/1983 Beale et al. ..... 60/520 X

*Primary Examiner*—Allen M. Ostrager

*Attorney, Agent, or Firm*—Frank H. Foster

[57] ABSTRACT

In a free piston Stirling engine, an improved method and apparatus for preventing the creep of the mean position of the piston as a result of leakage of the working gas between the working space and the bounce space. A passageway is formed between the bounce space and the working space and extends through ports which interface with the piston and the displacer. Unlike the prior art, the port in the piston which registers with another port is offset from the mean position of the piston. Instead, the ports register when the bounce space and working space pressures are supposed to be equal. Additionally, the displacer blocks another port to prevent communication between the bounce space and the work space when the piston is moving outwardly from the work space, but opens to permit communication, and an equalizing flow of gas to counterbalance leakage, when the piston is moving into the working space.

9 Claims, 4 Drawing Figures

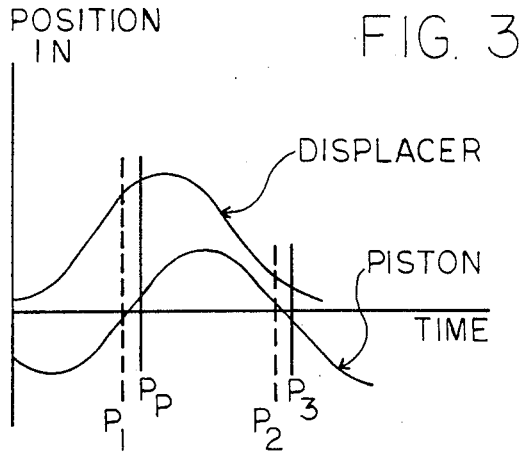
FIG. 3
FIG. 4
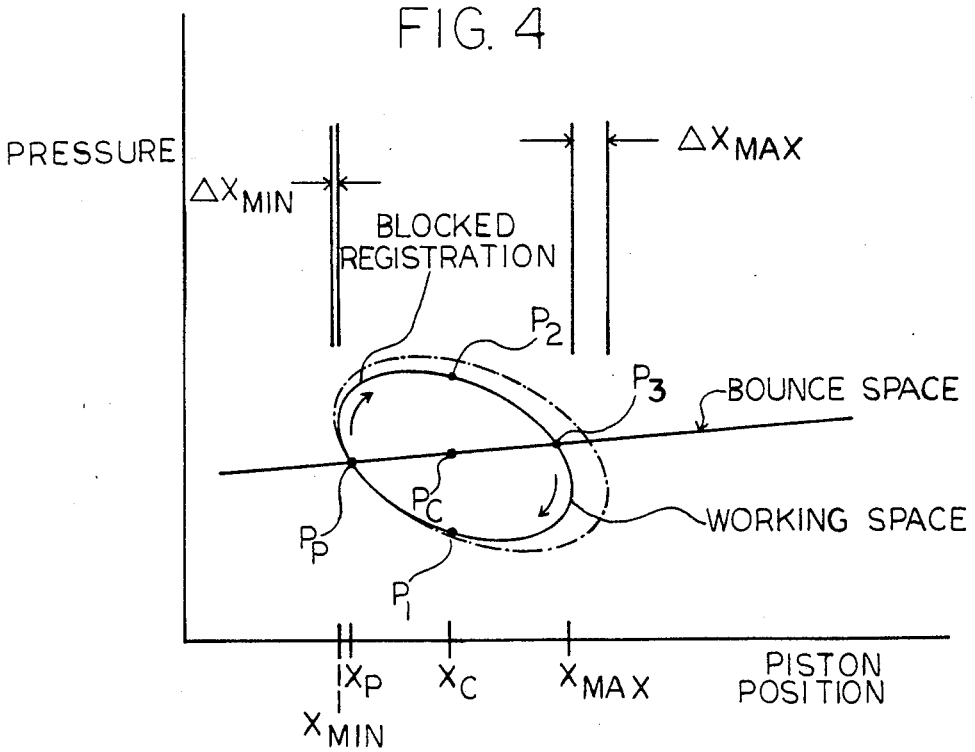

PISTON CENTERING METHOD AND APPARATUS FOR FREE-PISTON STIRLING ENGINES

TECHNICAL FIELD

This invention relates generally to free piston Stirling engines and more particularly relates to an improved method and apparatus for centering the power piston of the engine in a manner which improves its power output and other operating characteristics.

BACKGROUND ART

A free piston Stirling engine conventionally has a housing which contains a linearly reciprocating piston and a linearly reciprocating displacer. They are driven in reciprocation by the alternate expansion and compression of a working gas within the working space of the engine which acts against one end of the piston. A reference or bounce space acts against the other end of the piston.

The term "Stirling engine" is used in the broader sense of a Stirling cycle machine used either as a motor to convert heat energy to mechanical or as a heat pump by which mechanical energy is used to pump heat energy in order to either refrigerate or supply heat energy.

Attempts are made to seal, as efficiently as possible, the interfacing surfaces between the piston and the cylinder within which it slides. If the piston also slides upon a center post, sealing is maximixed between the center post and the piston. However, regardless of the effectiveness of the sealing, during operation it is well known that gas leaks past the piston between the work space and the bounce space. Unless corrective measures are taken, the net gas volume in one space will increase. The result is that the mean position of the reciprocating piston will tend to creep either toward or away from the work space.

Conventionally the prior art solution to this problem is to provide a passageway between the bounce space and the working space with a valve in the passageway which opens each time the piston passes its selected or design mean position. Typically, this is accomplished by means of a passageway which extends through the piston and a portion of the housing against which the piston slides. Opposed cooperating ports align in registration to open the passageway each time the piston passes its means position. In this manner, each time the ports come into registration, gas may flow through the passageway so that the average volume of gas in the work space and in the bounce space will remain unchanged during engin operation. Any net flow of gas by leakage past the piston will increase the pressure of the space into which it flowed at the instant the ports are in registration so that there will then be a net flow of gas through the passageway and back into the original space to counterbalance the leakage flow and stabilize the volume of gas in each space and therefore maintain the piston position.

I have discovered, however, that such a center porting piston centering system causes an unnecessary reduction in the power output from the free piston stirling engine. The reason is that the normal operating pressures of the work space and the bounce space are not equal at the mean piston position. Instead, as the piston is travelling outwardly from the work space, the work space pressure is greater than the bounce space pressure at the mean position of the piston. However, the prior art center porting system vents that pressure to the bounce space, thus reducing the force applied upon the piston for continuing its movement out of the work space. Conversely, when the piston is travelling inwardly toward the working space, the pressure of the working space is less than the pressure of the bounce space, but again, the conventional center porting system vents the bounce space pressure into the work space to reduce the total force applied on the piston. Thus, with the conventional piston centering technique, the centered ports come into registration twice each cycle at the mean position of the piston. Gas passes back and forth between the bounce space and the working space during each cycle, going one way during one part of the cycle and in the opposite way during another part. It is only the average or mean flow in one direction which compensates for the leakage flow in the opposite direction.

It is therefore a principal object of the present invention to provide a piston centering system which eliminates the power loss caused by the centering system and yet still prevents undesired piston creep.

BRIEF DISCLOSURE OF INVENTION

The present invention recognizes that the working gas pressure and the bounce space pressure do equalize during each cycle. However, these pressures equalize at two different intervals of each cycle at two different piston positions which are ordinarily spaced on opposite sides of the mean piston position. In accordance with the present invention, the bounce space and the working space are connected in communication with each other at a piston position which is one of the two positions in the cycle at which the bounce space pressure is equal to the working space pressure under normal design operation. This is preferably accomplished with registering, cooperating ports which are similar to the ports utilized in conventional piston centering systems but they are disposed offset from the mean position of the piston. Preferably, the passageway which is communicating between the bounce space and the work space is also valved by the displacer so that the displacer blocks communication through the passageway at the other place in the cycle where the ports come into registration but the pressures are unequal. Preferably this is the registration point at which the piston is travelling outwardly from the working space.

Thus, opening a communication path during a brief interval, only when the working space pressure and the bounce space pressure are supposed to be equal, does not reduce the power of the engine because at that interval the gas is not applying a resultant force to the piston. Nonetheless, the gas volume in the work space and the gas volume in the bounce space are kept substantially unchanged because any excess gas which flows by leakage into one space can pass during the interval of registration back into the other space.

Yet another advantage of the present invention is that by causing the passageway to be opened by the port registration during only the inward movement of the piston, the mean position of the piston will migrate outwardly away from the working space whenever piston amplitude increases as a result of decreased loading of the Stirling engine. Thus, undesired creep is prevented by maintaining the pressure equilibrium position of the piston at the point of registration when the passageway is open and yet any increase in piston oscillation amplitude moves the mean piston position outwardly to help avoid collision between the displacer and the piston as more work is delivered by the Stirling engine to the load.

BRIEF DESCRIPTION OF DRAWINGS

FIG. 3 is a graphical plot illustrating the displacer and piston motion plotted as a function of time over a cycle of operation.

FIG. 4 is a graphical plot of working space pressure and bounce space pressure plotted as a function of piston position illustrating the operation of the preferred embodiment of the invention.

Figure 1:
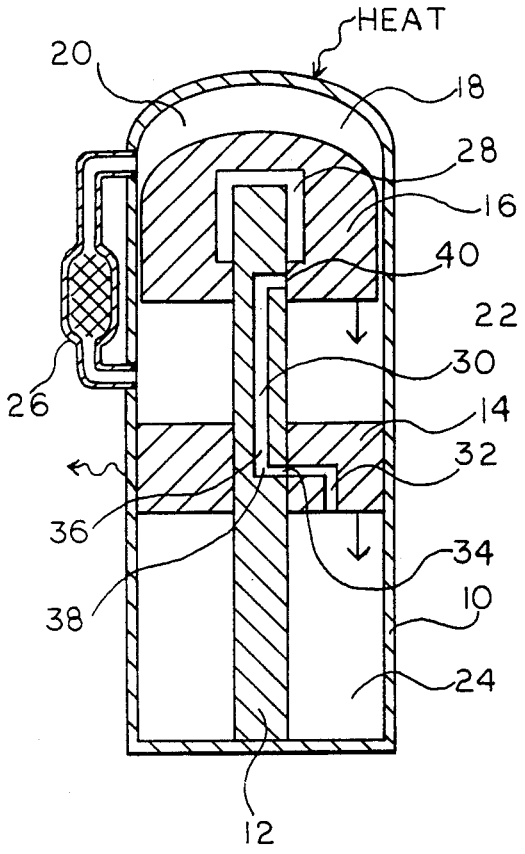
FIG. 1 is a diagrammatic illustration illustrating the operation of the preferred embodiment of the invention showing the piston positioned to open the passageway between the bounce space and the worrking space, but the displacer positioned to block communication through the passage.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

FIG. 1 illustrates a free piston Stirling engine having a relatively stationary support housing 10. The support housing 10 includes a center post 12 which is fixed to the remainder of the housing support 10. A reciprocating power piston 14 and a displacer 16 are driven in reciprocating oscillation in accordance with well known prior art principles by the alternate expansion and compression of a working gas in a working space 18. Heat is applied at the hot end 20 of the work space and removed from the cool end 22. In the conventional manner, the engine is also provided with a bounce space 24 which contains the identical gas as the working gas within the work space 18. The engine is also provided with a regenerator 26 and a gas spring 28 applying its spring force between the center post 12 and the displacer 16.

As is well known to those skilled in the art, there are a great many varieties of free piston Stirling engines which utilize the concepts illustrated in FIG. 1.

As illustrated in FIG. 3, the displacer and the piston reciprocate in approximately sinusoidal motion with the displacer leading the piston by a phase angle greater than zero degrees and less than 180 degrees.

FIG. 4 is a graphical plot illustrating the pressure of the bounce space and of the working space as a function of piston position. The straight line illustrates the variation of the bounce space pressure as the piston reciprocates between the extremes of its excursions Xmin and Xmax. The slope of the bounce space line is determined by the volume of the bounce space, a higher slope signifying a smaller bounce space.

The ellipse in FIG. 4 represents the variation in working space pressure as a function of piston position as the piston 14 reciprocates between its extreme excursions at Xmin and Xmax. As the piston moves inwardly toward the work space 18 (vertically upwardly in FIG. 1) when the piston arrives at its mean or center position Xc, the pressure P1 in the working space is less than the bounce space pressure Pc. Similarly, the work space pressure P2 is at a pressure greater than Pc when the piston is moving away from the working space and arrives at its mean position Xc. As also illustrated in FIG. 3, P1 and P2 representing the two instants of time in a cycle at which the piston 14 is at its mean position.

However, at the point Pp and at the point P3 the graphical plot representing the working space pressure and the graphical plot representing the bounce space pressure intersect. At these points the pressure of the working space and of the bounce space are equal if there has been no net leakage from one space to the other.

Under the principles of the present invention, a passageway is formed between the working space and the bounce space so that it is opened at the piston position Xp when the pressure in both spaces should be equal. If, however, gas has leaked in one direction, then the space with the additional gas will be at a slightly higher pressure which will cause gas to pass and return when the piston is positioned at the point Xp.

Referring now to FIG. 1, the passageway 30 connects the bounce space 24 and the working space 18 in communication with each other at the piston position Xp. As shown in FIG. 4, this piston position Xp is disposed from the mean position Xc.

The passageway 30 has at least one and preferably two valve means formed in the passageway 30 to block the passage of gas through the passageway 30 except at the particular time illustrated. Although a variety of different valve means of the types known in the art can be connected and linked to the piston and the displacer, the preferred type of valve means comprises passageways formed through a portion of the housing support 10, such as the center post 12. It is apparent, however, that the passageways can be, and have in the prior art been, formed through the cylinder wall or through other structures. In effect, these preferred valves are each a spool valve in which two relatively sliding surfaces with ports or other openings come into registration to open the valve and allow gas to pass during the registration. Otherwise, when the openings or parts are offset and out of registration, the passage of gas is prevented.

One of the valve means is linked to the piston for opening the valve for a relatively brief interval when the piston is at the selected position, preferably Xp, which is both disposed from the mean position Xc and on the intersection of the working space curve and the bounce space line. The piston is at a position where the bounce space pressure and the working space pressure are supposed to be equal.

The preferred valve is constructed by forming the passageway 30 with a leg 32 through the piston 14 and opening at a port 34 in the inner cylindrical wall of the piston 14. A second leg 36 of the passageway 30 extends through the center post 12 and also has a port 38 at the exterior, cylindrical surface of the center post 12. The port 34 comes into registration with the port 38 when the piston is at its position Xp. Of course, the ports will be in exact registration only for an instant, but will be in gas passing registration for an interval so long as one port overlaps the other.

Preferably a second spool valve arrangement is also formed by a port 40 at the opposite end of the leg 36 of the passageway 30. The leg 30 similarly opens through the cylindrical, exterior surface of the center post 12 to form the port 40. The other portion of the spool valve created at the port 40 is the inner cylindrical surface of the displacer 16 which slides along the center post 12. As illustrated in FIG. 1, the displacer moves to a position at which it blocks the port 40 to prevent the passage of gas through the passageway 30.

The operation of the preferred embodiment is illustrated in connection with all of the figures. As the piston 14 moves away from the work space 18 (downward in FIG. 1) and crosses its mean position Xc, the work space pressure will be P2 and the bounce space pressure will be Pc as illustrated in FIG. 4. However, since the port 34 is offset from the position Xp, the ports 34 and 38 will not be in registration and therefore no gas can pass through the passageway 30.

As the piston 14 continues out, it arrives at an intersection of the bounce space operating line with the working space pressure operating curve in FIG. 4 at which the work and bounce space pressures are P3. However, again the port 34 is offset from Xp so ports 34 and 38 will not be in registration and therefore no gas passes through the passageway 30.

Figure 2:
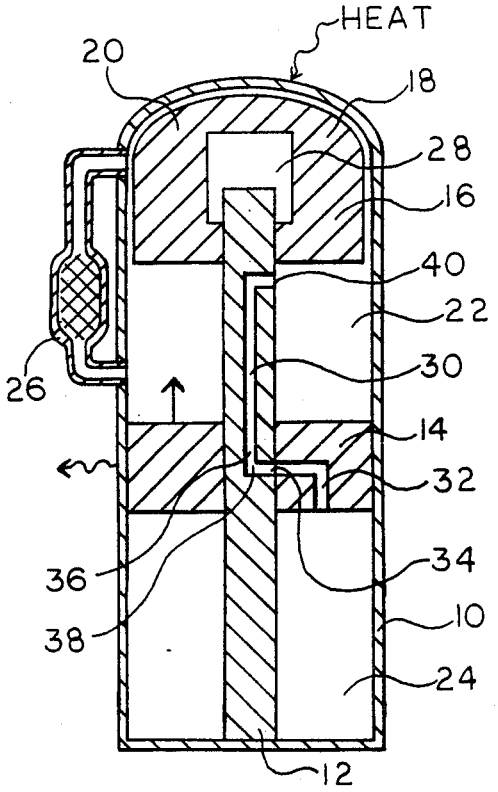
FIG. 2 is a view of the embodiment of FIG. 1 with the piston moving in the opposite direction and the displacer unblocking the passageway so that communication is established between the bounce space and the work space in accordance with the principles of the present invention.

As the cycle continues, the piston 14 reaches its maximum outward position, begins to travel in and passes its center position P1, illustrated in FIGS. 3 and 4. It continues in until the port 34 arrives at position Xp so that ports 34 and 38 come into registration. At that point, which is illustrated in FIG. 2, the piston will be at its position Xp and the displacer will be considerably further into the working space so that the port 40 is opened. This is also illustrated in FIG. 3 and allows an equalizing flow of gas.

The piston then continues its inward movement, reaches its inwardmost position Xmin and then begins to move out. When it reaches its position Xp the ports 34 and 38 will again come into registration. However, at that point, the displacer is at the position illustrated in FIG. 1 and there it blocks the passage of gas through the passageway 30.

Thus, the present invention permits gas flow through the passageway 30 only at one of the intersections of the bounce space and working space pressure diagrams and at only one part of the cycle when the ports 34 and 38 come into registration. Although the ports 34 and 38 come into registration twice each cycle, communication is blocked by the displacer during one of those two intervals of registration. It is blocked during the interval of registration when the work space pressure and bounce space pressure are not supposed to be equal and is unblocked during the interval when they are supposed to be equal. In particular, communication is blocked at the interval of registration when the piston is moving out of the work space.

Referring now to FIG. 4, if the load is reduced or disconnected from the power piston, the load being connected in any of the many well known conventional ways, this reduction of loading will cause the piston to oscillate at an increased amplitude. With a conventional centering system, a piston remains centered about the same mean position so that the excursions increase equally in both opposite directions. This, of course, increases the possibility that the piston and the displacer will collide and damage or destroy each other.

However, with the centering device of the present invention the position Xp at which the passageway 30 is vented or opened, is offset or disposed toward the displacer from the position Xc. Thus, as the ellipse, shown in phantom in FIG. 4 representing an increased stroke amplitude, increases its dimensions, it increases those dimensions about the offset point Xp and therefore there is a greater increase in amplitude $\Delta Xmax$ away from the displacer than there is an increase $\Delta Xmin$ toward the displacer. The result is that the mean position Xc migrates outwardly away from the displacer as the piston stroke increases and the position Xp remains the same. This reduces the possibility that the piston and the displacer will collide as a result of the increased stroke amplitude.

It is believed theoretically possible to design a Stirling engine so that one of the portions of the cycle during which the bounce space and working space pressures are supposed to be equal falls when the piston is at its mean position. However, the principles of the invention are still fully applicable.

While certain preferred embodiments of the present invention have been disclosed in detail, it is to be understood that various modifications may be adopted without departing from the spirit of the invention or scope of the following claims.

I claim:

1. In a free piston Stirling engine of the type having a housing support containing a reciprocating piston and displacer driven by the alternate expansion and compression of a working gas in a work space of the engine and also having a bounce space, an improved method for preventing the creep of the mean piston position from the leakage of working gas between the work space and the bounce space, the method comprising:

connecting the bounce space and the working space in communication with each other substantially only at a piston position at which the bounce space pressure is designed to equal the working space pressure under normal operation.

2. In a free piston Stirling engine of the type having a housing support containing a reciprocating piston and displacer driven by the alternate expansion and compression of a working gas in a work space of the engine and also having a bounce space, an improved method for preventing the creep of the mean piston position from the leakage of working gas between the work space and the bounce space, the method comprising:

connecting the bounce space and the working space in communication with each other for a brief interval at the piston position which is represented by one intersection of a graphical plot of the bounce space pressure plotted with respect to piston position with a graphical plot of the working gas pressure plotted with respect to piston position.

3. A method in accordance with claim 2 wherein the piston position represented by the intersection at which said communication is effected is further into the work space than the piston position represented by the other such intersection.

4. A method in accordance with claim 3 wherein said communication is effected by forming a passageway through the piston and through a portion of the housing support against which the piston and the displacer reciprocatingly slide, said passageway extending between the work space and the bounce space and including at least one pair of ports formed in each of two interfacing surfaces between the piston and the housing support and positioned to be in registration at said intersection at which said communication is established, and the passageway also including another port through a surface of said housing support along which a portion of the displacer slides and positioned to be uncovered by the displacer and be exposed to the work space at said intersection at which communication is established but to be covered by the displacer and blocked when said pair of ports come into registration at another part of the cycle.

5. In a free piston Stirling engine of the type having a housing support containing a reciprocating piston and displacer driven by the alternate expansion and compression of a working gas in a work space of the engine and also having a bounce space, an improved apparatus for preventing the creep of the mean piston position from the leakage of working gas between the work space and the bounce space, the apparatus comprising:

a passageway formed through said engine between said working space and said bounce space, said passageway including at least one valve means linked to the piston for opening the valve means for a relatively brief interval when the piston is at a selected position and the bounce space pressure is to be equal to the working space pressure and for blocking the passageway when the piston is at the same position but said pressures are to be unequal.

6. An apparatus in accordance with claim 5 wherein the passageway further includes a second valve means linked to the displacer for opening the second valve means during at least the selected portion of the engine operating cycle during which the first valve means is opened and the bounce space pressure is to be equal the working space pressure and for closing the second valve means at least during any other portion of the cycle during which the first valve means is opened.

7. An apparatus in accordance with claim 6 wherein said second valve means is arranged to be opened at the said cycle portion during which the displacer is further within the working space.

8. An apparatus in accordance with claim 7 wherein said valve means comprise spool valves formed respectively by the piston and the displacer each cooperating with a portion of the housing support against which it slides in reciprocation.

9. An apparatus in accordance with claim 8 wherein said housing support includes a center post and the piston and displacer are mounted coaxially on the center post for reciprocation thereon, and wherein said passage extends from the bounce space through said piston, through the center post and into the working space and wherein the first spool valve is formed by interfacing ports between the piston and the center post and the second spool valve is formed by a port on the center post and the interior surface of the displacer which slides along the center post.

* * * * *